US007150362B1

(12) United States Patent
Questiaux et al.

(10) Patent No.: US 7,150,362 B1
(45) Date of Patent: Dec. 19, 2006

(54) HOLDER FOR STORING A PLURALITY OF FASTENERS

(76) Inventors: Kenneth Ralph Questiaux, 124 Blakely Rd., Butler, PA (US) 16002; Jared Brian Kile, 127 Morningside Dr., Butler, PA (US) 16002

( * ) Notice: Subject to any disclaimer, the term of this patent is extended or adjusted under 35 U.S.C. 154(b) by 259 days.

(21) Appl. No.: 10/962,327

(22) Filed: Oct. 12, 2004

(51) Int. Cl.
*A47F 7/00* (2006.01)

(52) U.S. Cl. ..... 211/70.6; 211/59.1; 211/183

(58) Field of Classification Search ..... 211/70.6, 211/57.1, 183, 54.1, 59.1; 248/220.31, 220.41, 248/220.42, 220.43; 273/282.1; 446/1; 224/916

See application file for complete search history.

(56) References Cited

U.S. PATENT DOCUMENTS

| | | | | | |
|---|---|---|---|---|---|
| 2,621,807 | A | * | 12/1952 | Rendich | 269/54.5 |
| 3,310,271 | A | * | 3/1967 | King | 248/220.43 |
| 3,322,287 | A | * | 5/1967 | Ragir | 211/87.01 |
| 3,844,231 | A | * | 10/1974 | Peacock | 108/107 |
| 3,880,390 | A | * | 4/1975 | Niven | 248/220.43 |
| 4,113,109 | A | * | 9/1978 | Donnelli et al. | 211/49.1 |
| 4,167,264 | A | | 9/1979 | Kretzmeir | |
| 4,248,433 | A | * | 2/1981 | Soriano | 273/275 |
| 5,228,582 | A | | 7/1993 | Marshall et al. | |
| 5,284,256 | A | | 2/1994 | Correll-Antoun | |
| 5,379,976 | A | * | 1/1995 | DeGirolamo | 248/220.43 |
| 5,620,104 | A | * | 4/1997 | Maglione | 211/59.1 |
| 6,230,445 | B1 | * | 5/2001 | Arko et al. | 52/36.5 |
| 6,234,436 | B1 | * | 5/2001 | Kump | 248/220.21 |
| 6,481,584 | B1 | * | 11/2002 | Cantley | 211/87.01 |

FOREIGN PATENT DOCUMENTS

| | | | |
|---|---|---|---|
| NL | 2026850 | * | 9/1979 |

* cited by examiner

*Primary Examiner*—Jennifer E. Novosad
(74) *Attorney, Agent, or Firm*—Aileen Champion Addessi

(57) ABSTRACT

A holder for storing a plurality of fasteners includes a support member having a first side wall, a second side wall, and a plurality of web members positioned therebetween for holding the first and second walls in spaced apart relationship. The support member has a plurality of holes, each having a central aperture and a plurality of wavy slots extending radially outwardly therefrom for forming starburst shaped holes. The wavy slots have support member segments positioned therebetween which are flexible during installation and removal of the plurality of fasteners from the starburst shaped holes. The holder further includes an elongated bracket, a wire tie, or the like for holding differently shaped fasteners to the holder.

20 Claims, 4 Drawing Sheets

HOLDER FOR STORING A PLURALITY OF FASTENERS

BACKGROUND OF THE INVENTION

The invention relates to storage devices and, more particularly, to a holder for supporting and holding various sizes and types of fasteners.

When an automobile is disassembled for repair or maintenance, the fasteners, such as the bolts, screws, nuts, washers, or the like, are placed in a container. This bin type of storage stores the plurality of fasteners in a loose, bulk fashion without separation of the individual elements. For this type of storage method, the fasteners are not labeled and when an individual has to reassemble the parts of the automobile, it is difficult and time consuming to find the fastener that corresponds to and fits the automobile component.

A holder for screws, bolts, nuts and washers is disclosed in U.S. Pat. No. 5,228,582 to Marshall et al. The holder has a vertically oriented and rotatably mounted column having a plurality of spaced sets of holes for receiving and supporting various types of fasteners. However, the holder needs to be supported by a supporting structure.

U.S. Pat. No. 4,167,264 to Kretzmeir discloses a tool rack for supporting various types of tools. The tool rack includes a plurality of holes for holding the tools therein. However, the holes are formed in a rigid piece of material and the tool rack needs to be supported by a vise.

U.S. Pat. No. 5,284,256 to Correll-Antoun discloses a stand that is self supporting. However, the items are only loosely stored on shelves on the rack and will slid off of the stand, if the stand is not held in a stable position.

Therefore, what is needed is an apparatus for storing fasteners that includes a plurality of flexible holes for positively retaining the fasteners, that can be used multiple times to store various sized fasteners, and that does not need to be mounted or supported by any supporting structure.

SUMMARY OF THE INVENTION

A holder for storing a plurality of fasteners includes a support member formed of a flexible piece of material and has a plurality of holes for receiving and retaining the plurality of fasteners. Each of the plurality of holes has a central aperture disposed through the support member, and a plurality of wavy slots extending radially outward from the central aperture for forming a starburst shaped hole for receiving the plurality of fasteners. The starburst shaped hole has a plurality of support member segments positioned between each wavy slot, and the plurality of support member segments are bendable during disposition and removal of the plurality of fasteners. The starburst shaped holes are preferably used for elongated type of fasteners, such as bolts, screws, etc.

The support member has a first side wall and a second side wall positioned substantially parallel to one another, and has a plurality of web members positioned between the first and second side walls for positioning the first and second side walls in spaced apart relationship to one another. The web members are positioned substantially parallel and in spaced apart relation to one another for forming a channel between adjacent web members.

An elongated bracket may either be positioned within an opening or within the channel of the support member for retaining various types of fasteners. As an alternative to the use of the elongated bracket, a wire tie may be used to hold annular types of fasteners, such as washers, nuts, etc.

The holder may include the plurality of holes having a first set of holes positioned in close proximity to one another, a second set of holes positioned in close proximity to one another, and a third set of holes positioned in close proximity to one another for arranging the plurality of holes in a pattern allowing similarly sized holes to be positioned adjacent to one another.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention described herein provides an apparatus for holding fasteners that can be used to easily and quickly separate different types and sizes of fasteners and store the fasteners in a convenient transportable holder for providing positional maintenance of the individual elements.

Figure 1:
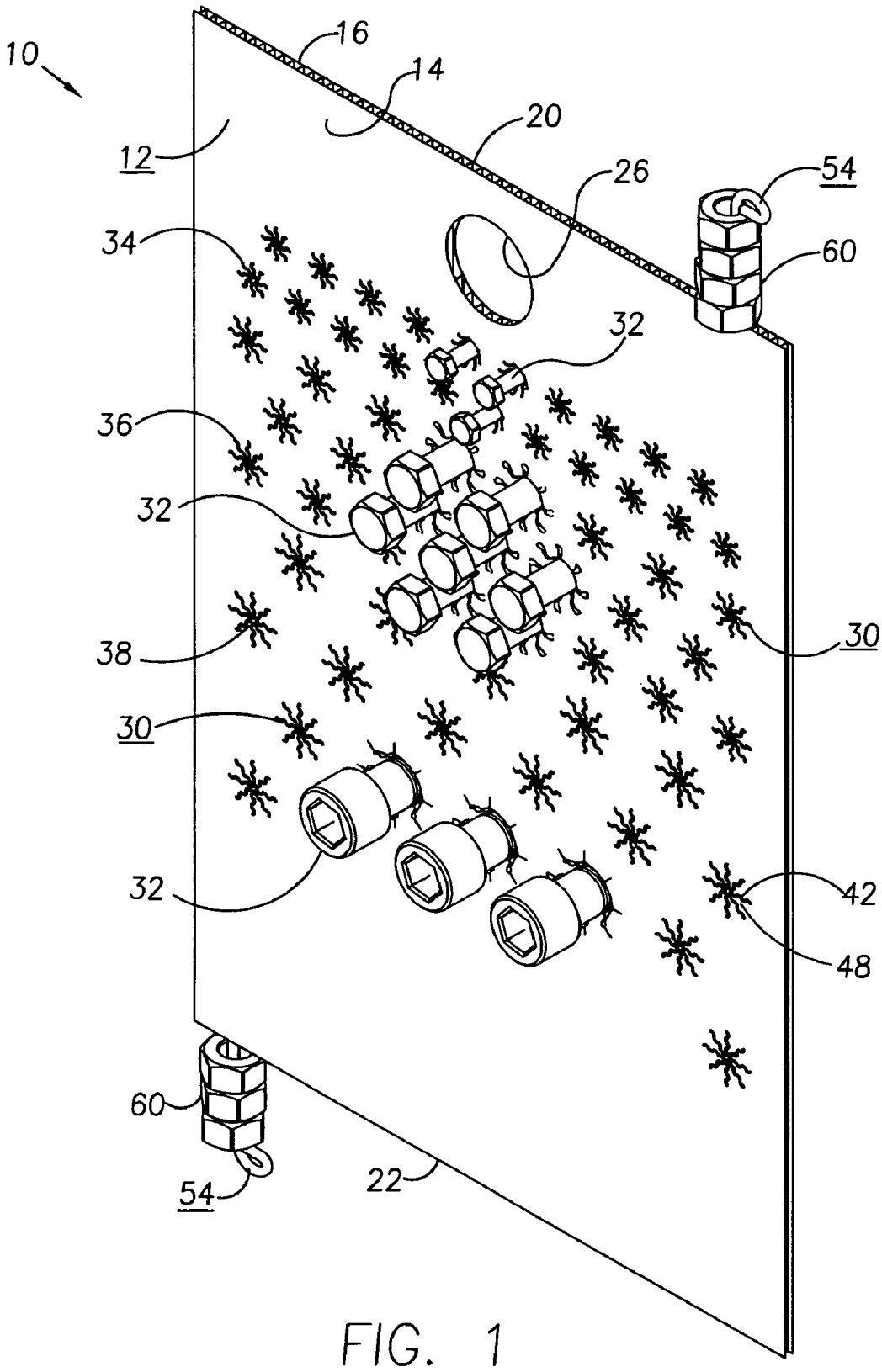
FIG. 1 is a perspective view of a holder for storing fasteners.

Referring to FIG. 1, a holder 10 for storing a plurality of fasteners includes a support member 12, such as a board or piece of material having a rectangular, square, triangular, or other suitable shape. The support member 12 has a first side wall 14 and a second side wall 16 positioned substantially parallel and in spaced apart relation to one another.

Figure 2:
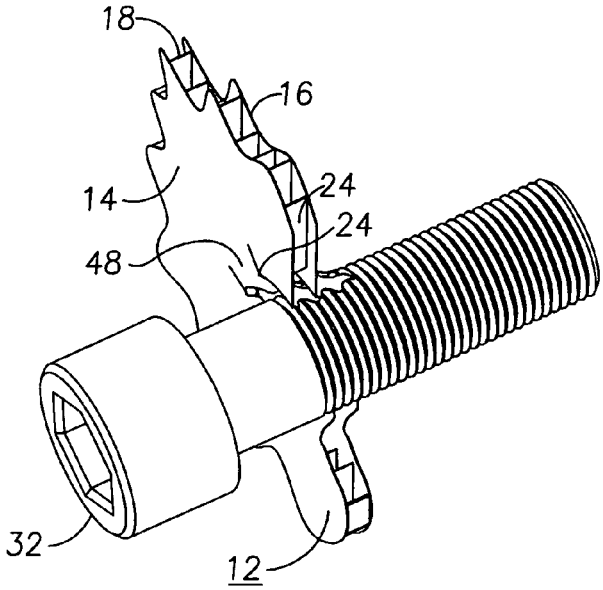
FIG. 2 is a partial perspective view of a bolt inserted through a hole in the holder.
Figure 3:
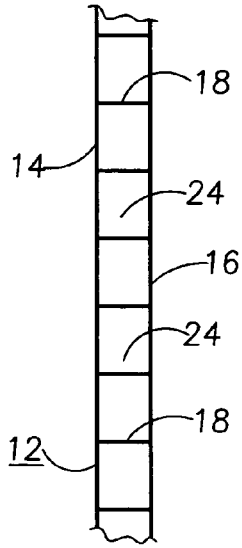
FIG. 3 is a partial side elevational view of the holder showing a plurality of web members and channels.

Referring to FIGS. 1–3, a plurality of web members 18 are positioned between and attached to the first side wall 14 and the second side wall 16 of the support member 12 for maintaining the spaced apart relationship of the side walls 14 and 16. The web members 18 extend from a first edge 20 to a second edge 22 of the support member 12 and are positioned substantially parallel to one another. The web members 18 form channels 24 between adjacent web members 18.

The support member 12 may be formed from a flexible type of material, such as plastic cardboard marketed under the tradename Coraplast or Plasticor, or any other suitable type of material. Preferably, the support member 12 is formed of a material that can withstand moisture or is coated with a material that can withstand moisture. Also, the type of material enables a person to draw with an erasable writing instrument, such as a dry erase marker or other type of washable marker, on the support member 12, and later have the markings removed for re-use of the same holder for another task. The person may mark the holder 10 with identification information, such as the owner's name of the automobile, the required type of work to be done, etc. The fasteners may also be labeled for ease of identification at a later time.

The support member 12 may have a hole 26 for enabling a person to grasp the holder 10 for carrying the holder. The hole 26 may also be used to hang the support member 12 on a hook (not shown).

The support member 12 has a plurality of holes 30 disposed therethrough. The holes 30 are sized for accepting various types and sizes of elongated fasteners, such as bolts 32, screws, or the like. The holes 30 are positioned in spaced apart relationship to one another and may be positioned in rows of similar sized holes, may be positioned randomly throughout the support member 12, or may be positioned in any desired pattern. Preferably, similar sized holes 30 are positioned in rows adjacent to one another for grouping similar types of fasteners together.

Referring to FIGS. 1, 4, 5, and 6, the holes 30 may include a first set of holes 34 having a first size, a second set of holes 36 having a second size, and a third set of holes 38 having a third size. Alternatively, the support member 12 may have any number of different sized holes.

Figure 4:
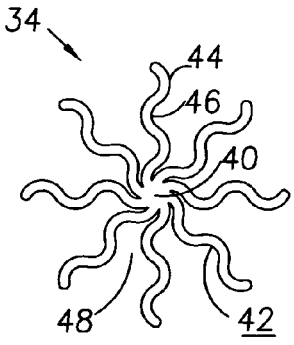
FIG. 4 is a plan view of one of the holes of the holder.
Figure 5:
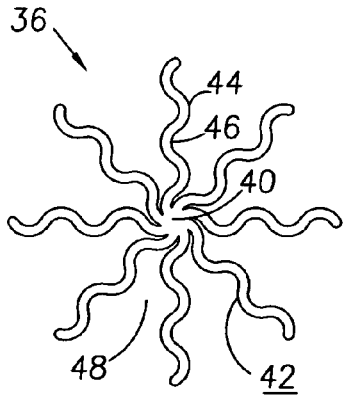
FIG. 5 is a plan view of another one of the holes.
Figure 6:
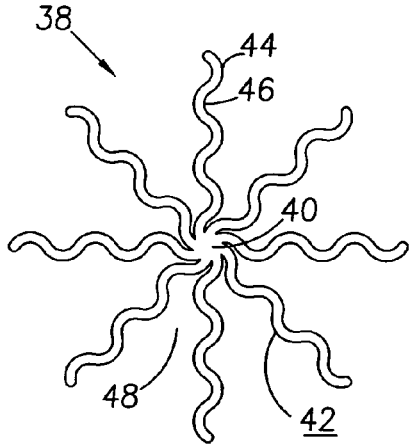
FIG. 6 is a plan view of yet another one of the holes.

Referring to FIGS. 4, 5 and 6, each hole 30 has a central aperture 40 and a plurality of wavy slots 42 extending radially outward from the central aperture 40 for forming a starburst shaped hole. Each wavy or curvilinear slot 42 has a shape which resembles a wavelength or wave form having at least one peak or crest 44 and at least one valley or trough 46. Smaller holes 30 have fewer crests 44 and troughs 46 for accepting smaller sized fasteners. Larger holes 30 have a greater number of crests 44 and troughs 46 for accepting larger sized fasteners. Positioned between adjacent wavy slots 42 are support member segments 48. These support member segments 48 are flexible for enabling the segments 48 to bend during insertion and removal of the fasteners from the support member 12. The shape of the slots 42 provides strength to the support member 12 and enables the support member 12 to be repeatedly used, while still maintaining a secure positioning of the fasteners within the support member 12.

As illustrated in FIG. 2, the support member segments 48 may remain in a bent or deformed position while the fastener is in the hole 30. The flexibility of the hole 30 enables different sized fasteners to be positioned in a single hole 30.

For the various embodiments of this invention, the same reference characters will be used to designate like parts. In addition, like functions and like interactions of the parts among the various embodiments of this invention will not be repeated for each embodiment.

Figure 7:
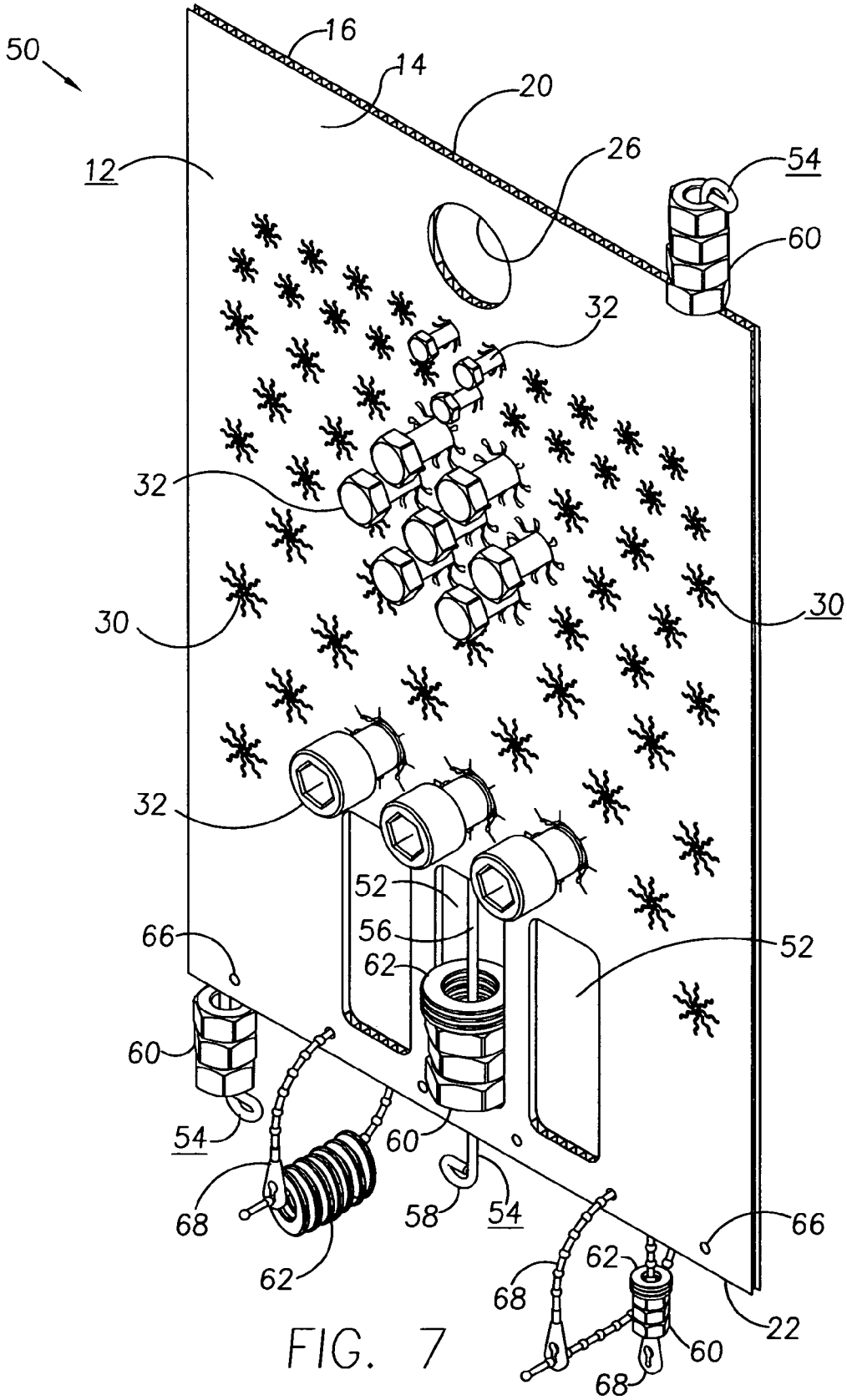
FIG. 7 is an alternative view of the holder having a plurality of openings for storage of different types of fasteners.

Referring to FIG. 7 and using the same reference characters to define like parts, an alternative embodiment of the holder 10 as illustrated in FIG. 1 may be a holder 50 having like parts as the holder 10 and additionally having at least one opening 52. An elongated bracket 54 may be attached to the support member 12, may be engagable with the support member 12, or secured by any other suitable means. As illustrated in FIG. 7, the elongated bracket 54 has a shank 56 and a protuberance 58 for retaining a plurality of fasteners, such as nuts 60 and washers 62. The nuts 60 and washers 62 may be slid onto the shank 56 of the elongated bracket 54 and retained by the protuberance 58. The shank 56 end of the elongated bracket 54 may then be inserted through one of the channels 24 of the support member 12, or otherwise attached to the support member 12. As illustrated in FIG. 7, the elongated bracket 54 may be disposed through the opening 52 for retaining and positioning the fasteners in the opening 52, or may be disposed on an outer edge of the support member 12, in which case the fasteners extend outwardly from the support member 12.

Additionally, the support member 12 may have holes 66 for insertion of a wire tie 68 or other attachment means for holding a plurality of annular fasteners, such as washers 62 and nuts 60. The holes 66 may be positioned adjacent to the outside perimeter of the support member 12.

Figure 8:
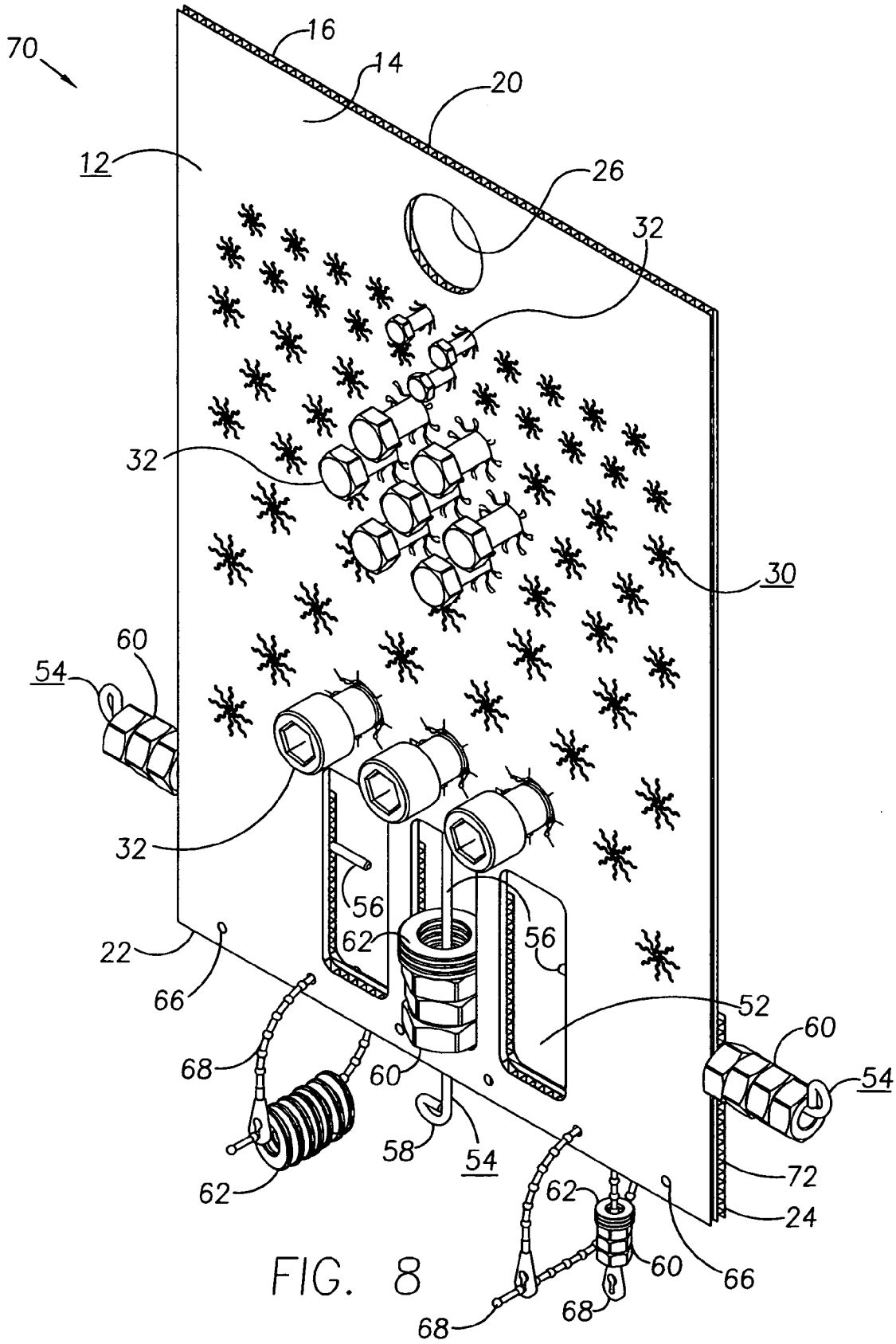
FIG. 8 is yet another alternative view of the holder having a reinforcerment member.

Referring to FIG. 8 and using the same reference characters to define like parts, an alternative embodiment of the holders 10 and 50 as illustrated in FIGS. 1 and 7 may be a holder 70 having like parts as the holders 10 and 50 and additionally having a reinforcement member 72 for providing additional strength to the support member 12. The reinforcement member 72 also provides additional channels 24 for insertion of the elongated bracket 54.

In operation, one of the holders 10, 50, or 70 is selected by an individual, such as an automobile mechanic. As the person removes fasteners from the automobile, the bolts and screws can be inserted into correspondingly sized starburst holes 30. The nuts and washers can be secured to the support member 12 either on the elongated bracket 54, a wire tie 68, or the like. The holder 10, 50 or 70 with the attached fasteners can be conveniently placed in the automobile while waiting for parts, etc.

An advantage of the holders 10, 50 and 70 is that because the holders can be stored in the automobile, the holders do not require a separate area of the garage to store each customer's fasteners. Also, because the holders are within each automobile, the mechanic can quickly and easily locate the holder when the fasteners are needed. Additionally, there is less of a likelihood that different customers' fasteners will be mixed up.

Another advantage of the holders 10, 50 and 70 is that fasteners from one part of the automobile can be stored in adjacently positioned starburst holes 30 for enabling a person to quickly and easily locate the fasteners during reinstallation of the components of the automobile, saving time and money. Because of the type of material used for the support member 12, a person can use a writing instrument to mark the support member 12. For example, a person could circle the holes 30 that contain parts from a particular component of the automobile, such as all of the fasteners removed from a fender of the automobile could be enclosed within the circle. All of the fasteners removed from a hood of the automobile could be enclosed within another circle.

Yet another advantage of the holders 10, 50 and 70 is that because of the unique characteristics of the material of the support member 12 and the design of the starburst holes 30, the holders can be used multiple times without breaking, thereby extending the useful life of the holders.

Another advantage of the holder is that the fasteners are stored separately, allowing segregation of different fasteners relative to each other. The holder eliminates the loose, bulk storage of the fasteners, which creates disorder and confusion. This holder allows for positional maintenance of the fasteners, and also allows maintenance of similar fasteners in groups that are readily accessible for selection of the individual items.

Another advantage of the holder is that the holder does not require any supporting structure. The holder can be leaned against or laid flat against any surface, such as the seat of the automobile, the floor of the automobile, or the like. In any position, the fasteners remain coupled to the support member 12.

There has been shown and described a novel holder for storing a plurality of fasteners which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

We claim:

1. A holder for storing a plurality of fasteners, comprising:

a support member formed of a flexible piece of material and having a plurality of holes for receiving and retaining the plurality of fasteners; and each of the plurality of holes having a central aperture disposed through the support member, and having a plurality of wavy slots extending radially outward from the central aperture for forming a starburst shaped hole for receiving the plurality of fasteners, the starburst shaped hole having a plurality of support member segments positioned between each wavy slot, the plurality of support member segments bendable during disposition and removal of the plurality of fasteners.

2. The holder according to claim 1, wherein the support member has a first side wall and a second side wall positioned substantially parallel to one another, the support member having a plurality of web members positioned between the first and second side walls for positioning the first and second side walls in spaced apart relationship to one another.

3. The holder according to claim 2, wherein:

the support member has a first edge and a second edge positioned opposite to one another; and the web members are positioned substantially parallel and in spaced apart relation to one another for forming a channel between adjacent web members, the web members extend from the first edge of the support member to the second edge of the support member.

4. The holder according to claim 1, further comprising:

the support member having at least one opening extending from the first side wall to the second side wall; and an elongated bracket securable to the support member and extending within the at least one opening for receiving and containing the plurality of fasteners within the at least one opening of the support member.

5. The holder according to claim 3, further comprising an elongated bracket engagable with the channel formed between adjacent web members of the support member for retaining at least one of the plurality of fasteners.

6. The holder according to claim 1, further comprising an elongated bracket engagable with the support member for storing the plurality of fasteners.

7. The holder according to claim 1, wherein the wavy slots of the plurality of holes include the wavy slots having at least one crest and at least one trough for forming the shape of the wavy slots.

8. The holder according to claim 1, further comprising a wire tie engagable with the support member for storing the plurality of fasteners.

9. The holder according to claim 1, wherein the plurality of holes includes a first set of holes positioned in close proximity to one another, a second set of holes positioned in close proximity to one another, and a third set of holes positioned in close proximity to one another for arranging the plurality of holes in a pattern allowing similarly sized holes to be positioned adjacent to one another.

10. A holder for storing a plurality of fasteners, comprising:

a support member having a first side wall and a second side wall positioned substantially parallel to one another, the support member having a plurality of web members positioned between the first and second side walls for positioning the first and second side walls in spaced apart relationship to one another; and the support member having a plurality of holes extending from the first side wall to the second side wall for receiving and retaining the plurality of fasteners and having a plurality of support member segments bendable during disposition and removal of the plurality of fasteners.

11. The holder according to claim 10, wherein the plurality of holes each further comprise:

a central aperture disposed through the support member; and a plurality of wavy slots extending radially outward from the central aperture for forming a starburst shaped hole for receiving the plurality of fasteners, the starburst shaped hole having the plurality of support member segments positioned between each wavy slot.

12. The holder according to claim 10, wherein:

the support member has a first edge and a second edge positioned opposite to one another; and the web members are positioned substantially parallel and in spaced apart relation to one another for forming a channel between adjacent web members, the web members extend from the first edge of the support member to the second edge of the support member.

13. The holder according to claim 12, further comprising an elongated bracket engagable with the channel formed between adjacent web members of the support member for retaining at least one of the plurality of fasteners.

14. The holder according to claim 11, wherein the wavy slots of the plurality of holes include the wavy slots having at least one crest and at least one trough for forming the shape of the wavy slots.

15. The holder according to claim 10, further comprising a wire tie engagable with the support member for storing the plurality of fasteners.

16. The holder according to claim 10, wherein the plurality of holes includes a first set of holes positioned in close proximity to one another, a second set of holes positioned in close proximity to one another, and a third set of holes positioned in close proximity to one another for arranging the plurality holes in a pattern allowing similarly sized holes to be positioned adjacent to one another.

17. A holder for storing a plurality of fasteners, comprising:

a support member having a first side wall and a second side wall positioned substantially parallel to one another, the support member having a plurality of web members positioned between the first and second side walls for positioning the first and second side walls in spaced apart relationship to one another; and the support member having a plurality of holes extending from the first side wall to the second side wall for receiving and retaining the plurality of fasteners, each of the plurality of holes having a central aperture disposed therethrough, and having a plurality of wavy slots extending radially outward from the central aperture for forming a starburst shaped hole for receiving the plurality of fasteners, the starburst shaped hole having a plurality of support member segments positioned between each wavy slot, the plurality of support member segments bendable during disposition and removal of the plurality of fasteners.

18. The holder according to claim 17, wherein:

the support member has a first edge and a second edge positioned opposite to one another;

the web members are positioned substantially parallel and in spaced apart relation to one another for forming a channel between adjacent web members, the web members extend from the first edge of the support member to the second edge of the support member; and an elongated bracket engagable with the channel formed between adjacent web members of the support member for retaining at least one of the plurality of fasteners.

19. The holder according to claim 17, further comprising:

the support member having at least one opening extending from the first side wall to the second side wall; and an elongated bracket securable to the support member and extending within the at least one opening for receiving and containing the plurality of fasteners within the at least one opening of the support member.

20. The holder according to claim 17, further comprising a wire tie engagable with the support member for storing the plurality of fasteners.

* * * * *